United States Patent [19]

Lin

[11] Patent Number: 4,513,974

[45] Date of Patent: Apr. 30, 1985

[54] CHESS BOX

[76] Inventor: Hong-Pei Lin, Fl. 2, No. 381, Sec. 5 Nan-Ching East Rd., Taipei, Taiwan

[21] Appl. No.: 580,728

[22] Filed: Feb. 16, 1984

[51] Int. Cl.[3] ..... A63F 3/00

[52] U.S. Cl. ..... 273/239; 273/284; 273/285; 273/287; 220/336; 206/579; 206/818

[58] Field of Search ..... 273/239, 284, 287, 148 R, 273/280, 283, 285, 309; 220/20, 336; 206/818, 206/315.1, 579

[56] References Cited

U.S. PATENT DOCUMENTS

| | | | |
|---|---|---|---|
| 597,755 | 1/1898 | Wilson | 273/287 |
| 2,665,913 | 10/1951 | Hlavac | 273/239 |
| 2,949,951 | 8/1960 | Schoen | 220/336 |
| 4,043,559 | 9/1977 | Eigen | 273/284 |
| 4,312,507 | 1/1982 | Smith | 273/287 |

FOREIGN PATENT DOCUMENTS

| | | | |
|---|---|---|---|
| 7623 | 5/1884 | United Kingdom | 220/336 |

*Primary Examiner*—Richard C. Pinkham
*Assistant Examiner*—Benjamin Layno
*Attorney, Agent, or Firm*—Lowe King Price & Becker

[57] ABSTRACT

A novel chess box comprising a main body portion having a magnet at its center, a lid hinged on the main body portion, a pair of containers each pivoted on the main body portion and provided with a sheet iron, a positioning plate removably mounted on the main body portion, a number of boards for various kinds of board games, and a plurality of playing pieces for playing with the board games.

6 Claims, 7 Drawing Figures

CHESS BOX

BACKGROUND OF THE INVENTION

Although many apparatuses for board games have been developed, none of them can lead to satisfactory results because the playing pieces such as chessmen or the like and the board are placed separately thereby causing much inconvenience. Moreover, such an apparatus for board game merely provides a kind of board game and only allows two persons to play at the same time.

Thus, the inventor of the present invention has contrived to design an improved chess box to mitigate such inconvenience.

SUMMARY

It is a primary object of the present invention to provide a novel chess box which may obviate the above-mentioned drawbacks.

It is another object of the present invention to provide a novel chess box which may offer various kinds of board games.

It is still another object of the present invention to provide a novel chess box which is convenient to carry.

It is still another object of the present invention to provide a novel chess box which is simple in structure.

It is still another object of the present invention to provide a novel chess box which is easy to produce.

It is still another object of the present invention to provide a novel chess box which is economic to produce.

It is a further object of the present invention to provide a novel chess box which is attractive in appearance.

Other objects and merits and a fuller understanding of the present invention will be obtained by those having ordinary skill in the art when the following detailed description of the best mode contemplated for practicing the invention has been read in conjunction with the accompanying drawings wherein like numerals refer to like or similar parts and in which:

DETAILED DESCRIPTION OF THE PREFERRED EMBODIMENT

Figure 1:
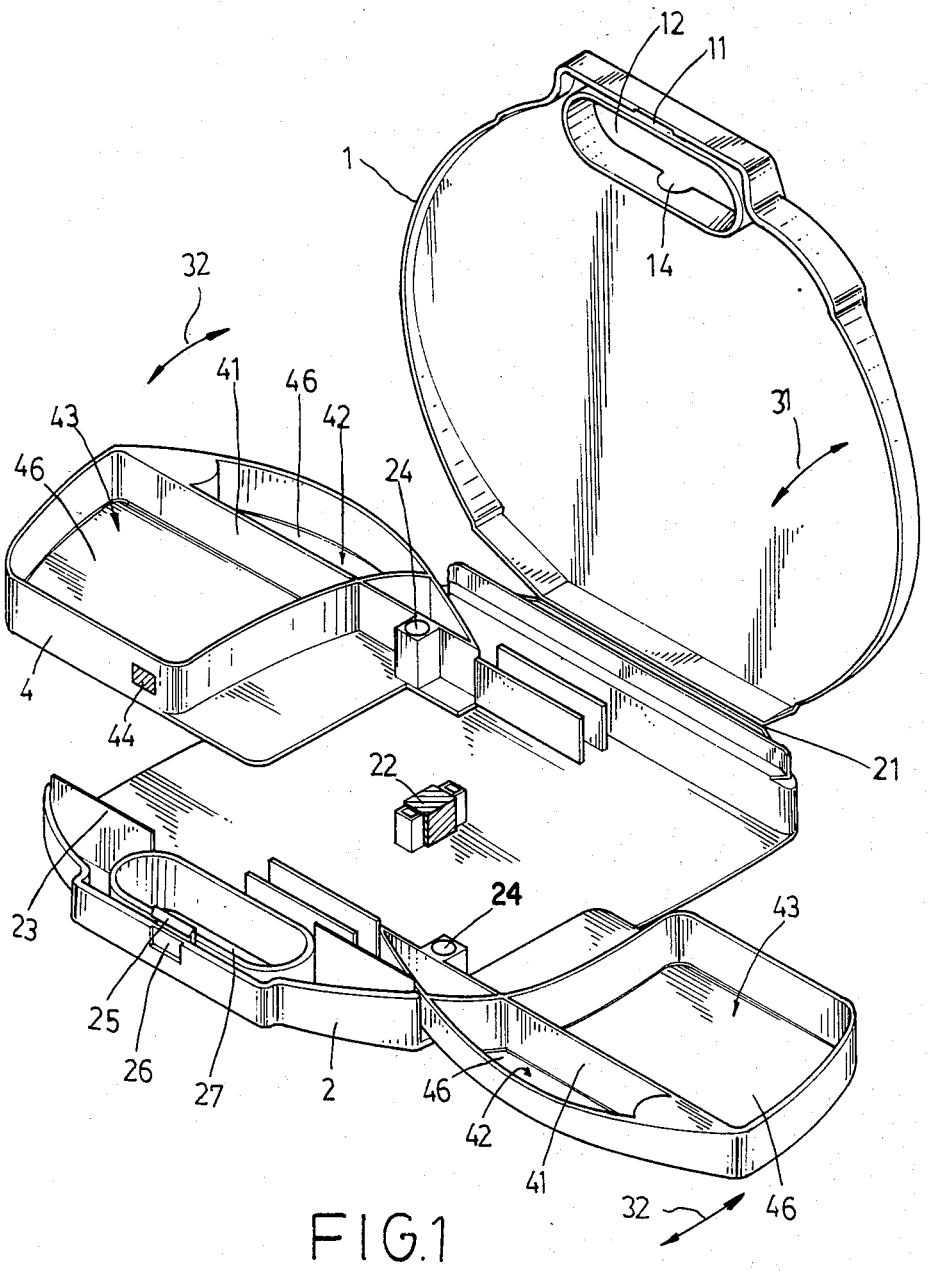
FIG. 1 shows the interior of a novel chess box embodying the present invention.
Figure 2:
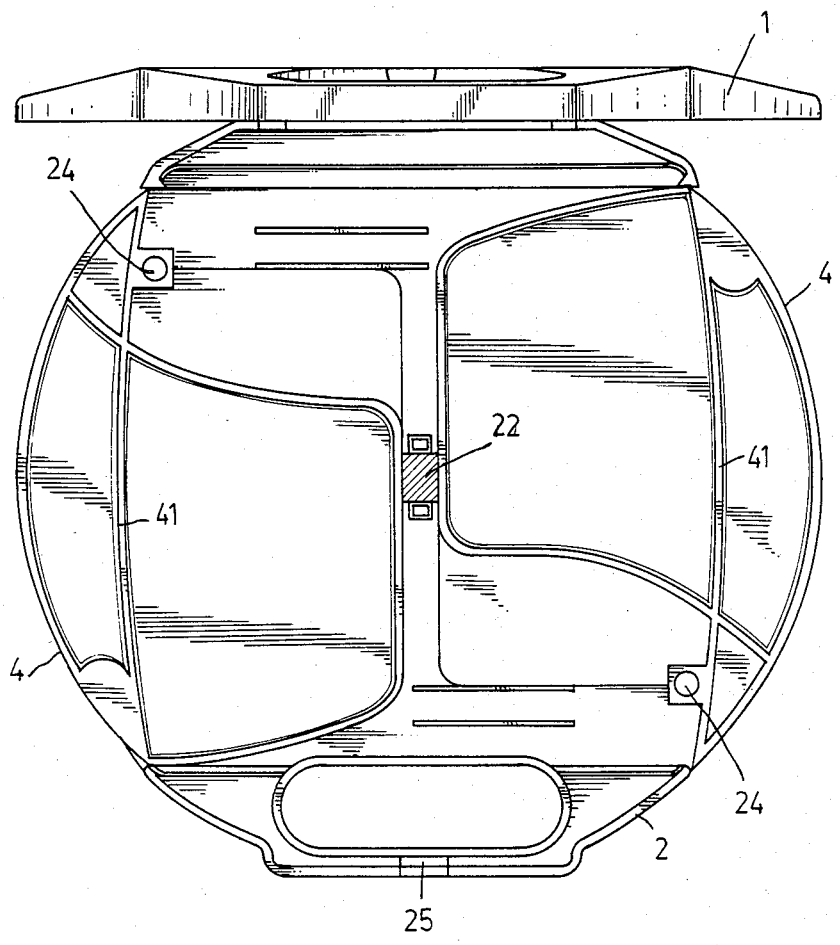
FIG. 2 is a top view of the novel chess box with its lid opened and two containers closed.

With reference now to the drawings and in particular to FIG. 1 thereof, the novel chess box according to the present invention comprises a main body portion (2) on which is rotatably mounted a lid (1) by a hinge (21) such that the lid (1) may rotate about the hinge (21) in the directions as indicated by arrow (31).

At the center of the main body portion (2) is fixedly attached a magnet (22). The main body portion (2) is further provided with positioning edges (23) at two sides and two pins (24) at two diagonal corners. Two containers (43) each provided with a sheet iron (46) at its bottom and divided into two compartments (43) and (42) by a partition (41) are pivoted on the main body portion (2) by the two pins (24) respectively, enabling each of the containers (4) to be rotated about its corresponding pin (24) in the directions as indicated by arrow (32). Each of the container (4) is equipped with a sheet iron (44) which is designed so that when the containers (4) are turned into the main body portion (2), the sheet iron (4) will be in contact with the magnet (22). Accordingly, the containers (4) will not be opened unintentionally. It is noted that the playing pieces (the chessmen or the like) of the present invention are provided with a magnet so that they can be retained into the containers (4) and will not be moved out of the containers (4) accidentally.

Figure 3:
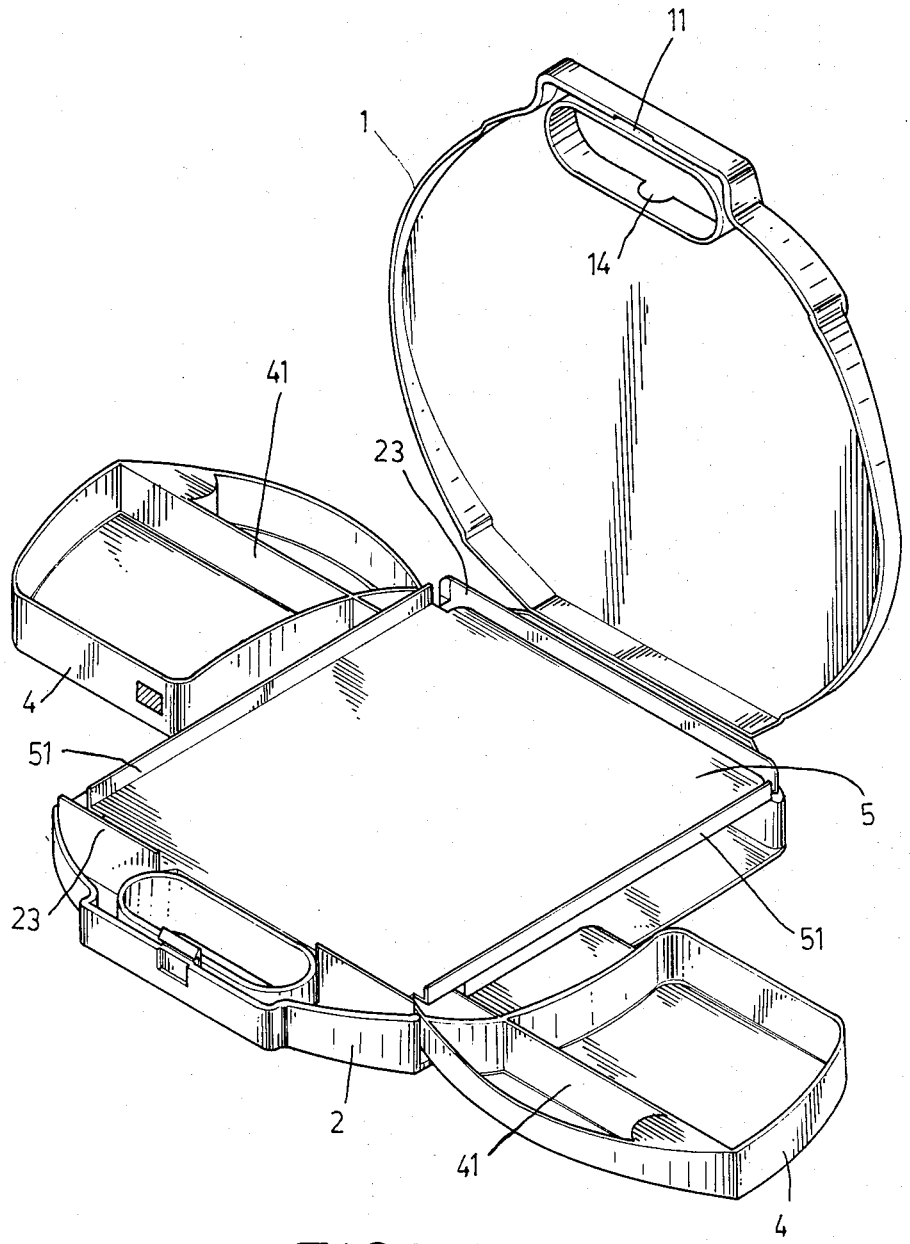
FIG. 3 shows the novel chess box with a positioning plate mounted thereon.
Figure 4:
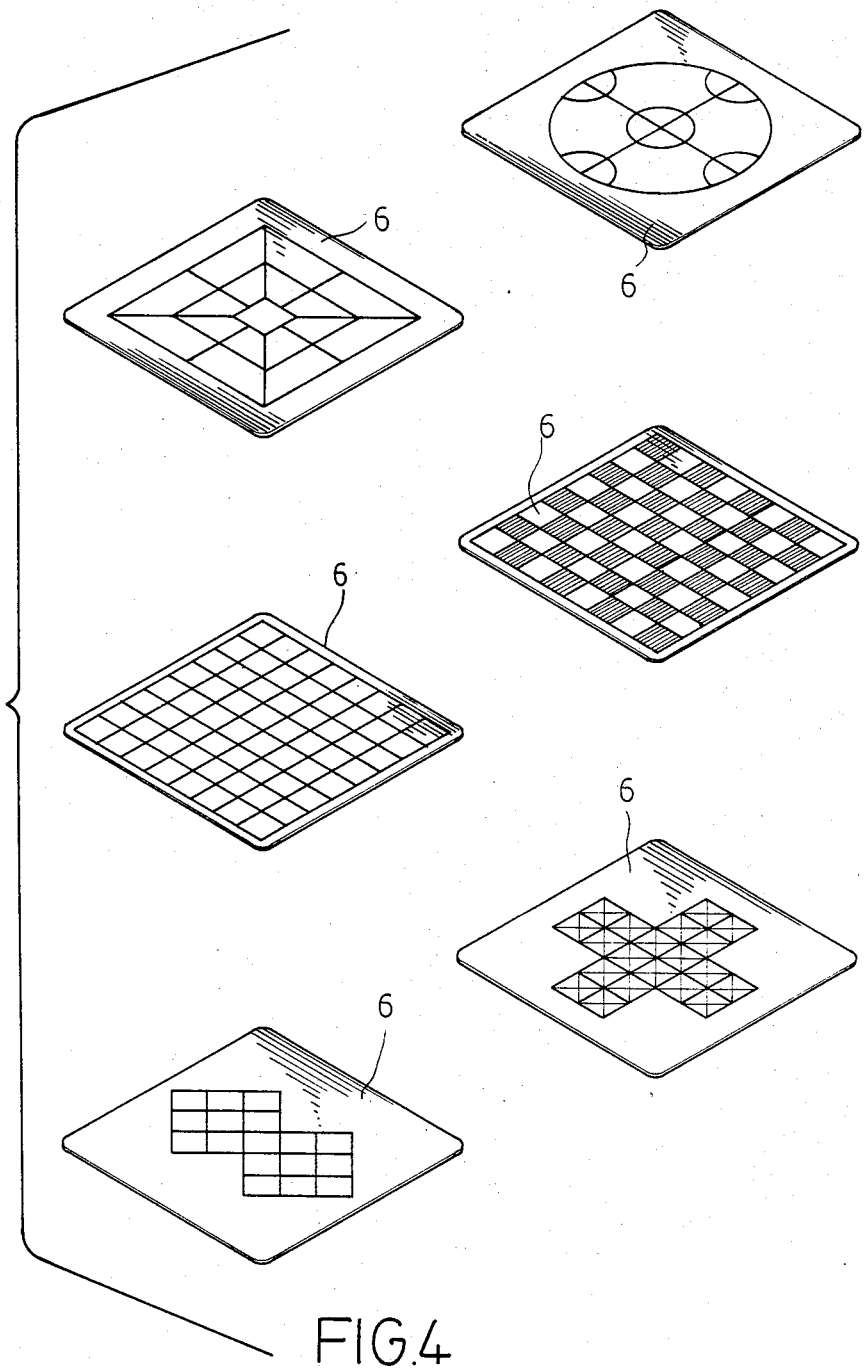
FIG. 4 shows six boards for different kinds of board grames.

Turning to FIG. 3, on the main body portion (2) is mounted a positioning plate (5) having two positioning edges (51) which, when cooperated with edges (23) of the main body portion (2), will form a closed recess on which boards (6) shown in FIG. 4 and the specifications (not shown) of board games may be placed.

To close the novel chess box according to the present invention, first turn the two containers (4) into the main body portion (2) so that the sheet iron (44) of each container (4) will be in contact with the magnet (22). Place the positioning plate (5) on the main body portion (2) in the way such that its two positioning edges (51) will cooperate with the edges (23) of the main body portion (2) to form a closed recess. Put the boards (6) and the specifications (not shown) on the positioning plate (5). Then, engage slot (11) of the lid (1) with hook-like connector (25) of the main body portion (2) to close the novel chess box according to the present invention. As shown in FIG. 1, a recess (25) is provided under the hook-like connector (25) so as to facilitate the opening of the novel chess box.

Figure 5:
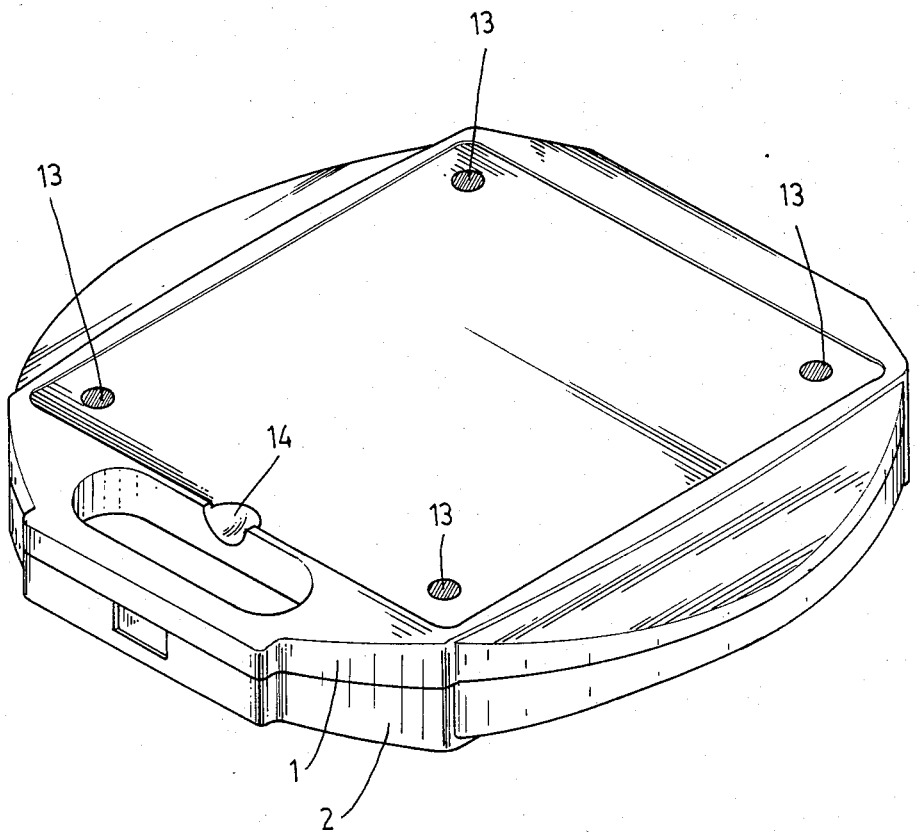
FIG. 5 is a perspective view of the novel chess box in the state of the closing.

With reference to FIGS. 1 and 5, the lid (1) and the main body portion (2) are provided with two slots (12) and (27) which will form a handle when the novel chess box is closed. On the top of the lid (1) there is a recess for receiving one of the boards (6). The recess is provided with a magnet (13) at each corner such that the board (6) which is made of sheet iron may be firmly attached on the top of the lid (1). Further, a notch (14) is provided on the edge of the lid (1) so as to facilitate the removing of the board (6) on the lid (1).

Figure 6:
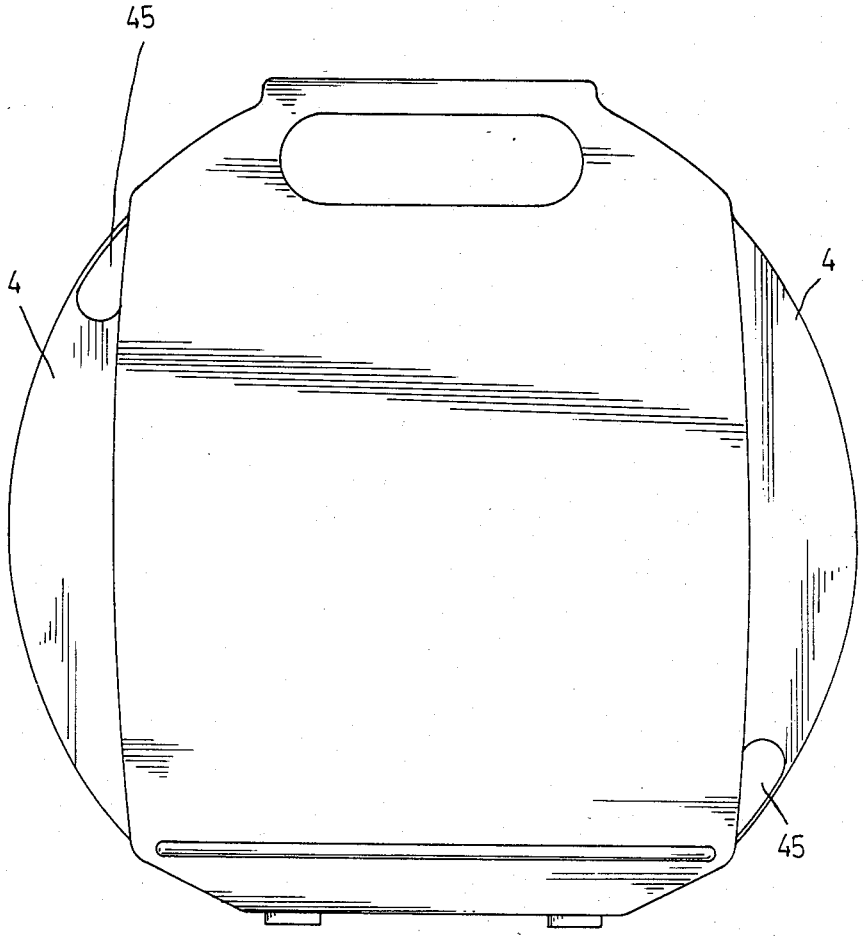
FIG. 6 is a bottom view of the novel chess box.
Figure 7:
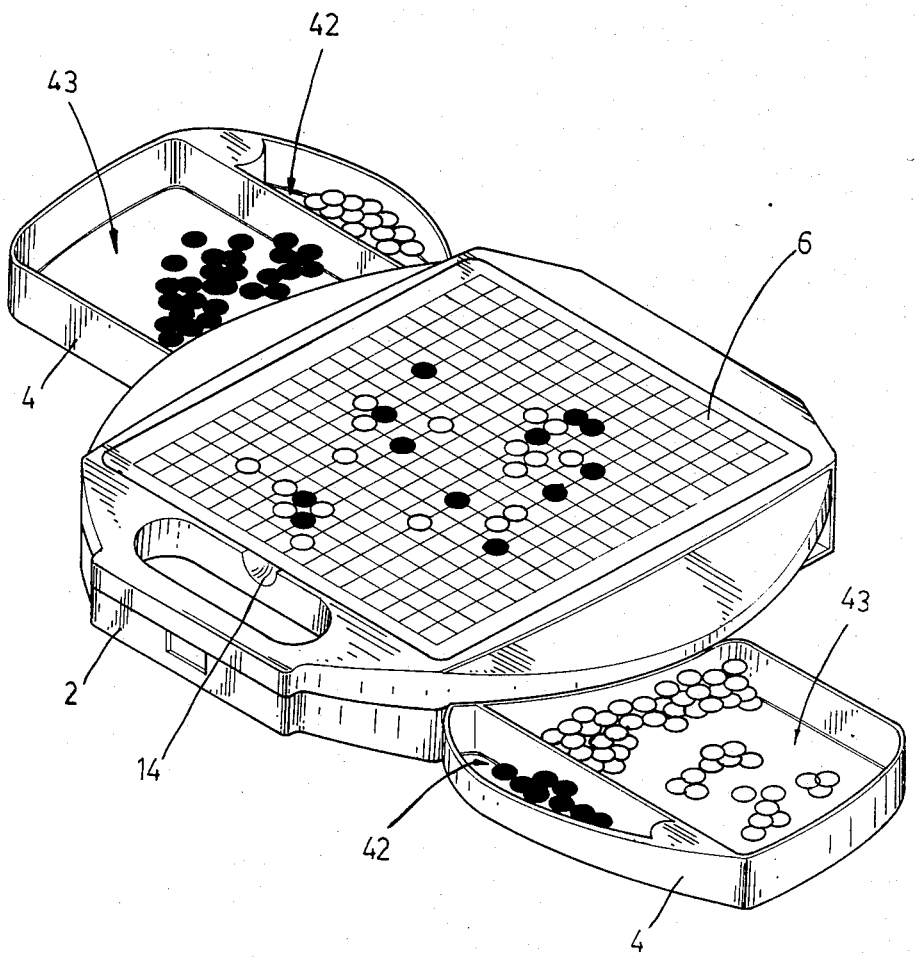
FIG. 7 shows an application of the novel chess board.

With reference to FIG. 6, there is shown a bottom view of the novel chess box according to the present invention. As illustrated, each of the containers (4) is provided with a cavity (45) by means of which the containers (4) may be pulled out easily.

In use, first open the novel chess box. Take out a desired board (6). Pull out the containers (4). Put down the lid (1) on the main body portion (2). Then, place the desired board on the top of the lid (1). The captured playing pieces (chessmen or the like) may be conveniently put into the compartments (42) of the containers (4) while the compartments (43) of the container (4) are served for receiving the playing pieces (chessmen or the like) to be set out on the board.

After use, first put the playing pieces (chessmen or the like) into the compartments (43) of the containers (4). Remove the board (6) from the top of the lid (1) via the cavity (14). Open the lid (1). Place the board (6) into the positioning plate (5). Close the lid (1) and then push the containers (4) into the main body portion (2).

Although the present invention has been described with a certain degree of particularity, it is understood that the present disclosure has been made by way of example only and that numerous changes in the detail of construction and arrangement of parts may be resorted to without departing from the spirit and scope of the invention as hereinafter claimed.

I claim:

1. A novel chess box comprising:

a main body portion having a magnet at its center;

a lid hinged on said main body portion;

a pair of containers each of which is pivoted on said main body portion and provided with a sheet iron which is designed so that said sheet iron will be in contact with said magnet of said main body portion when said container is turned into said main body portion;

a positioning plate removably mounted on said main body portion;

a number of boards of various kinds of board games placed on said positioning plate and capable of being mounted on the top of said lid; and a plurality of playing pieces for playing with said board games.

2. A novel chess box as claimed in claim 1, wherein each said container is provided with a sheet iron on its bottom.

3. A novel chess box as claimed in claim 1, wherein each said container is partitioned into two compartments.

4. A novel chess box as claimed in claim 1, wherein each said container is provided with a cavity at its bottom.

5. A novel chess box as claimed in claim 1, wherein said lid is provided with a number of magnets on its top.

6. A novel chess box is claimed in claim 1, wherein each said playing piece is provided with a magnet.

* * * * *